United States Patent [19]

Miller

[11] Patent Number: 4,626,409

[45] Date of Patent: Dec. 2, 1986

[54] ALUMINIUM ALLOYS

[75] Inventor: William S. Miller, Gerrards Cross, England

[73] Assignee: Alcan International Limited, Montreal, Canada

[21] Appl. No.: 595,446

[22] Filed: Mar. 30, 1984

[30] Foreign Application Priority Data

Mar. 31, 1983 [GB] United Kingdom ..... 8308907
Mar. 31, 1983 [GB] United Kingdom ..... 8308908

[51] Int. Cl.[4] ..... C22C 21/16
[52] U.S. Cl. ..... 420/533; 148/12.7 A; 148/417; 420/532
[58] Field of Search ..... 420/533, 532; 148/2, 148/11.5 A, 12.7 A, 417, 439

[56] References Cited

U.S. PATENT DOCUMENTS 3,984,260 10/1976 Watts et al. ..... 148/2

*Primary Examiner*—R. Dean
*Attorney, Agent, or Firm*—Browdy and Neimark

[57] ABSTRACT

An aluminium base alloy having a composition within the following ranges in weight percent:

| | |
|---|---|
| Lithium | 2.3 to 2.9 |
| Magnesium | 0.5 to 1.0 |
| Copper | 1.6 to 2.4 |
| Zirconium | 0.05 to 0.25 |
| Titanium | 0 to 0.5 |
| Manganese | 0 to 0.5 |
| Nickel | 0 to 0.5 |
| Chromium | 0 to 0.5 |
| Zinc | 0 to 2.0 |
| Aluminium | Remainder (apart from incidental impurities). |

20 Claims, 3 Drawing Figures

ALUMINIUM ALLOYS

Figure 1:
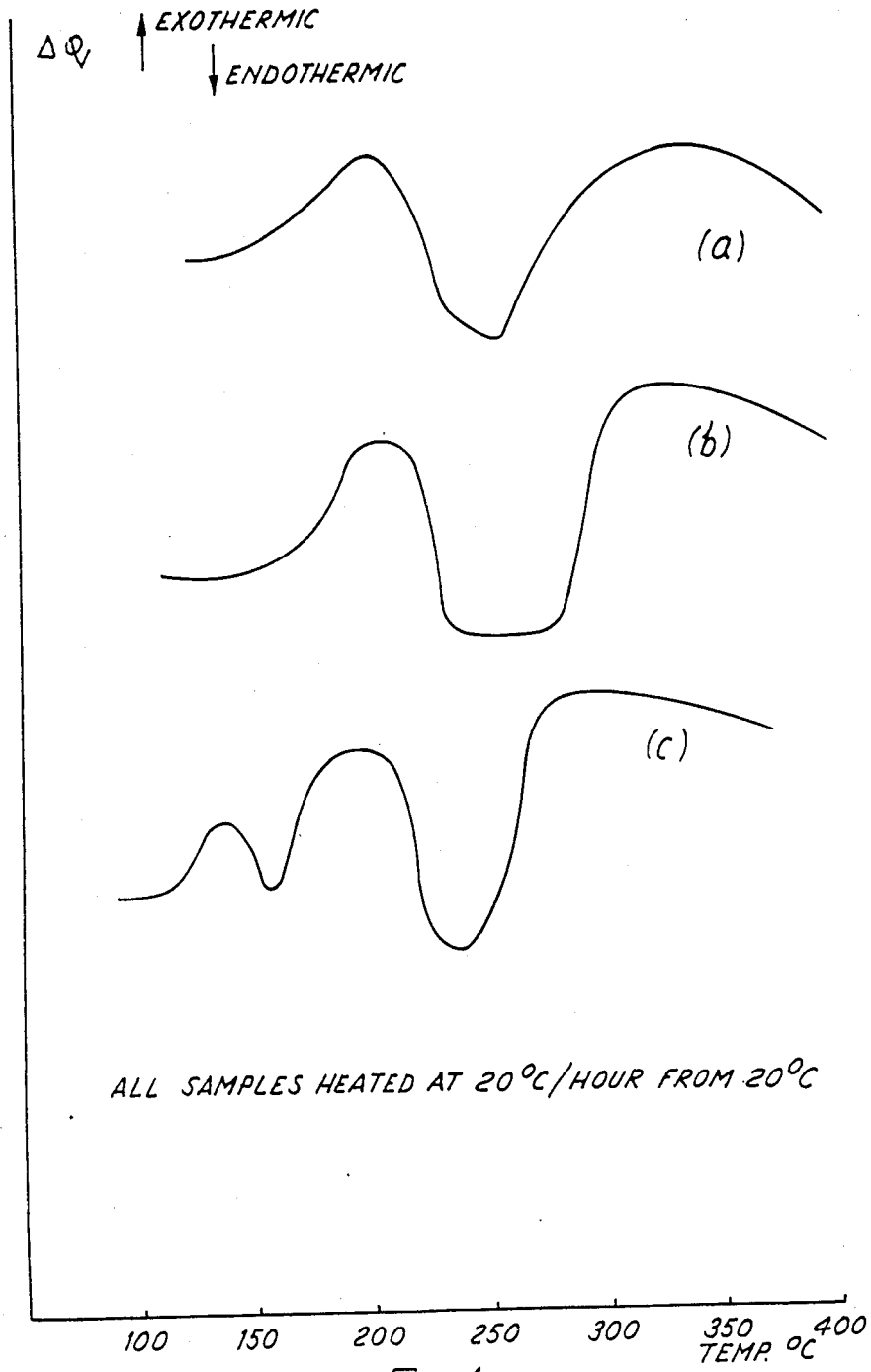

This invention relates to aluminium/lithium alloys which are particularly suitable for aerospace air frame construction.

Such alloys are attractive in providing significant weight reduction, of up to 20% over other aluminium alloys, and it is known that they can present high strength and stiffness and have good corrosion resistant properties. However they have, in the past, in comparison with other aircraft alloys, suffered from a reduction in other properties such as fracture toughness and have also been difficult to cast and subsequently work.

Most previously proposed Al/Li alloys have been based either upon the Al/Li/Mg system including, for example Li, 2.1% and Mg, 5.5% or on using a relatively high level of lithium addition to conventional aerospace alloys via powder metallurgy, for example an addition of 3% or more Li to alloy 2024. More recently additions of Mg and Cu have been proposed, for example Li, 3% or more; Cu, about 1.5%, Mg, about 2%, and zirconium about 0.18%. This gave alloys with improved fracture toughness and also facilitated hot and cold working.

We have now found that additional improvements to ease of production and subsequent working can be achieved by further modifying the lithium, magnesium and copper content of the alloy and by subjecting a hot rolled blank produced from a cast ingot to specific thermal treatments.

According to one aspect of the present invention there is provided an aluminium base alloy consisting of a composition within the following ranges in weight percent:

| | |
|---|---|
| Lithium | 2.3 to 2.9 |
| Magnesium | 0.5 to 1.0 |
| Copper | 1.6 to 2.4 |
| Zirconium | 0.05 to 0.25 |
| Titanium | 0 to 0.5 |
| Manganese | 0 to 0.5 |
| Nickel | 0 to 0.5 |
| Chromium | 0 to 0.5 |
| Zinc | 0 to 2.0 |
| Aluminium | Remainder (apart from incidental impurities). |

It has been found that a much larger copper to magnesium ratio than has hitherto been proposed is advantageous. Preferably this ratio is about 3:1 and may vary from 1.6:1 to 4.8:1 and significantly improves the precipitation strengthening response of the alloy giving enhanced strength with acceptable fracture toughness. Zirconium is included for its known properties in control of grain size and the optional additions of one or more of the elements titanium, manganese, nickel and chromium may also control grain size and grain growth upon recrystallisation. The optional addition of zinc enhances the superplastic characteristics of the alloy and also gives a strength contribution.

It has long been recognised that mechanical deformation, by processes such as hot and cold rolling, can lead to the development of crystallographic preferred orientation in metallic materials in sheet or strip form. This manifests itself in several ways, most of which are considerably detrimental to the properties of the product. In particular, anisotropy of mechanical properties can result so that the strength and ductility of the wrought, or wrought and annealed, product can vary appreciably according to the direction within the plane of the sheet or strip in which the properties are measured. These effects are common in the simple aluminium based alloys such as those of the 1000, 3000 or 5000 series (as designated by the Aluminum Association) but are not encountered to a detrimental effect in the aluminium alloys of the 2000 and 7000 series that are normally used in aircraft construction. However, experimentation in the development of aluminium-lithium based alloys has revealed that considerable problems of anisotropy of properties results when the alloys are processed by routes similar to those employed for 2000 and 7000 series alloys. Additionally, the techniques of control of anisotropy conventionally applied to the 1000, 3000 and 5000 series alloys, such as control of the Fe:Si ratio, cannot be applied to the aluminium-lithium based alloys because iron levels are, necessarily, kept low. It has, therefore, been necessary to develop special thermal and mechanical processing techniques to control anisotropy of mechanical properties, and particularly elongation, within acceptable bounds in these alloys.

Our copending application No. 8308907 filed on 31st March 1983 discloses a heat treatment technique applicable generally to Al/Li alloys and which is particularly suitable for the alloy of the present invention.

The present invention therefore also provides a method of producing a sheet or strip comprising hot rolling a rolling ingot of an alloy according to the present invention in one or more stages to produce a hot blank; holding the hot blank at a temperature and for a time which causes substantially all of the lithium, magnesium, copper and any zinc present to be in solid solution; positively cooling the hot blank; subjecting the cooled blank to a further heat treatment to reprecipitate those age hardening phases in solid solution, continuing the heat treatment to produce a coarse overaged morphology and thereafter cold rolling the blank to form a sheet or strip which at any position therein and in any direction therefrom has properties of elongation that vary from those in the rolling direction by no more than 2.0%. The sheet or strip may, at any position therein and in any direction therefrom have tensile strength properties that vary from those in the rolling direction by no more than 25 MPa (0.2% proof stress and tensile stress).

The initial holding temperature may be between 480° C. and 540° C. and the time may vary between 20 and 120 minutes depending upon the thickness of the blank and the blank's prior thermal history. If the hot blank falls to a temperature below 480° C. the blank may be re-heated to solutionise the Li, Mg, Cu and any Zn.

Preferably the hot blank has a thickness of 12.5 mm to 3 mm. The sheet or strip may have a thickness up to 10 mm and preferably has a thickness of no more than 5 mm. Advantageously the hot blank is positively cooled.

The positive cooling may terminate at the temperature of the further heat treatment so that the positive cooling and further heat treatment steps are merged together. The further heat treatment will generally be at a temperature between 300° C. and 400° C. for a period of 8 to 16 hours.

It has been found that not only does this thermal treatment of the blank control the anisotropy of the cold rolled sheet or strip but it also facilitates subsequent cold rolling and, in the case of a super-plastic alloy, enhances its superplastic properties.

Figure 2:
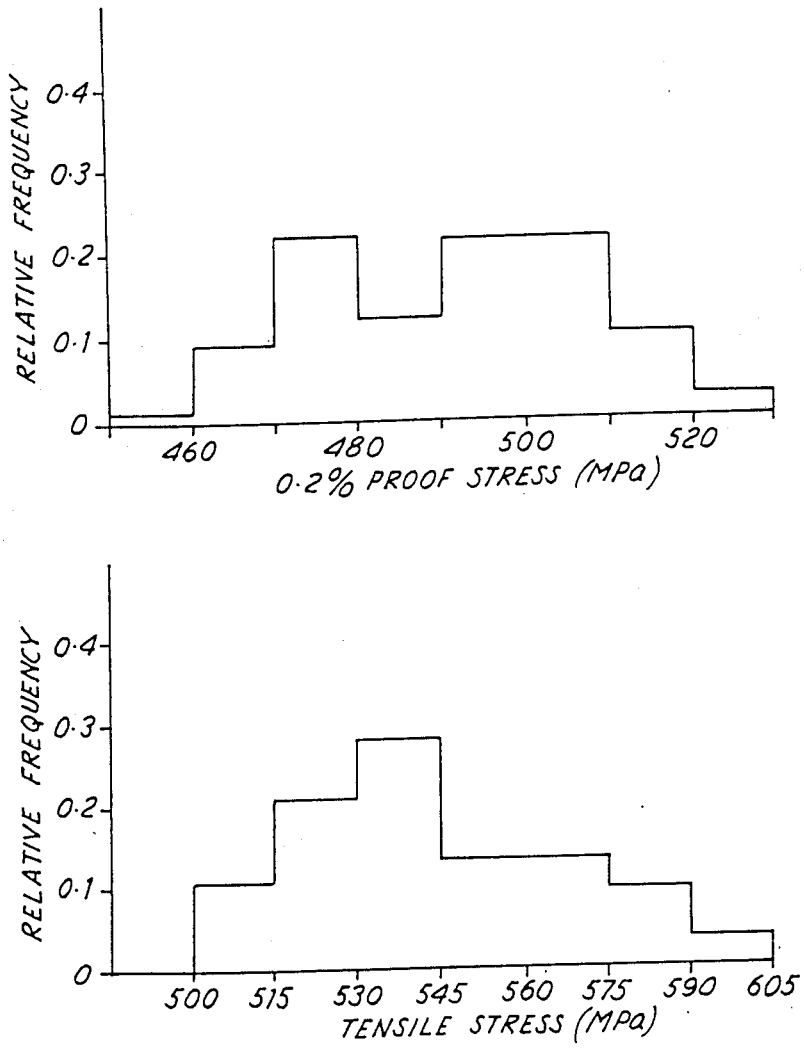
Figure 3:
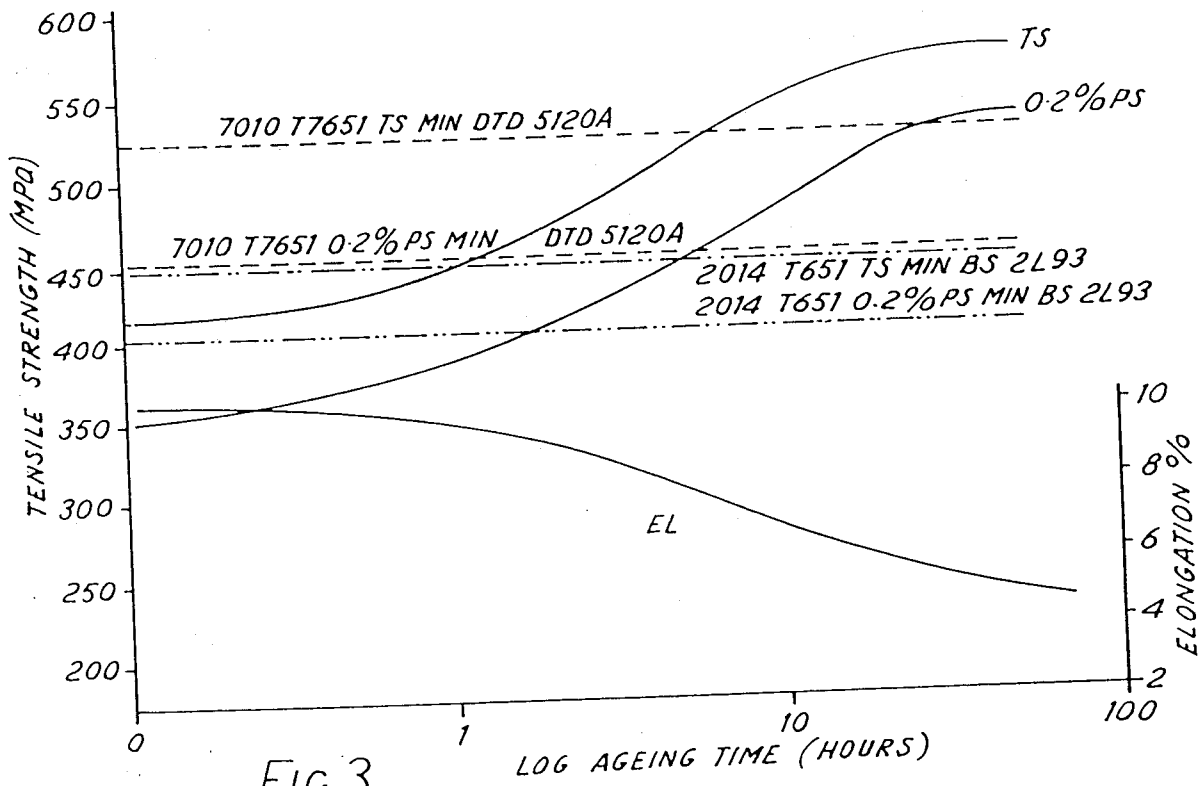

The invention will now be further described in relation to the following examples and with reference to the accompanying drawings, in which:

FIG. 1 is a graph showing differential scanning calorimetry plots for three alloy compositions and, FIGS. 2 and 3 are respectively graphs showing variations in tensile properties with ageing time and statistical data on the tensile properties.

It has been found that the copper to magnesium ratio is an important feature in enabling the alloy to achieve enhanced strength with acceptable fracture toughness compared to hitherto proposed alloy compositions. This is illustrated in FIG. 1 which shows differential scanning calorimetry plots for three alloy compositions. Firstly graph (a) for an aluminium alloy with 2.5% Li, 2.0% Cu, 0.7% Mg and 0.12% Zr shows ageing peaks at ~200° C. and ~325° C. the peak at 200° C. being attributable to the $Al/Li_3$ phase and that at 325° C. to the combined precipitation of the S-phase (Al-Cu-Mg) and equilibrium Al/Li phase. In graph (b) for an aluminium alloy containing 2.5% Li, 2.0% Cu, 0.45% Mg and 0.12% Zr i.e. below the specification of the present invention with regard to Mg, there now exists a flat base between 250° C. and 285° C. indicative of lack of precipitation of the S-phase. Finally in graph (c) for an aluminium alloy containing 2.5% Li, 2.0% Cu, 1.1% Mg and 0.12% Zr i.e. above the specification of the present invention with regard to Mg there now exists an additional Al-Cu-Mg precipitation mechanism at ~140° C.

It has been well established that Al/Li base alloys have poor ductility and low fracture toughness due to the inability of the $Al/Li_3$ precipitates to disperse slip during deformations. Alloys according to the present invention maximise the precipitation of the S-phase which acts to disperse slip and hence maximise strength, ductility and toughness.

EXAMPLE 1

| Alloy composition (in weight percent) | |
|---|---|
| Lithium | 2.5 |
| Magnesium | 0.6 |
| Copper | 2.1 |
| Zirconium | 0.14 |
| Chromium | 0.05 |
| Titanium | 0.013 |
| Aluminium | Remainder (including incidental impurities) |

The alloy was cast as 508 mm×178 mm 300 kg ingot in a direct chill casting system. The ingots were then homogenised for 16 hours at 540° C. and scalped to remove surface imperfections. The ingot was then preheated, again to 540° C. and hot rolled to 25 mm plate.

The plate was solution treated at 540° C. for one hour, cold water quenched, stretched to a 2% permanent extension and the tensile strength of the material assessed after ageing for various periods of time at 170° C. The longitudinal tensile properties are shown in FIG. 2 compared to 2014 T651 and 7010 T7651 minimum specified property levels. The alloy is shown to have strength levels considerably in excess of the minimum requirements of the comparison alloys. In the peak aged solution (ageing for 60 hours at 170° C.) the alloy exhibits an 0.2% proof stress approximately 100 MPa higher than found typically in 2014 T651 plate of equivalent thickness; the tensile strength being approximately 80 MPa higher than found typically in 2014 T651. Furthermore, the alloy has been shown to have fracture toughness values 20% higher than 2014 T651 (both materials tested in the fully heat treated temper).

The alloy in all heat treated conditions has a density decrease of 8–10% and a modulus increase of 10–15% when compared to all existing specified aluminium aerospace alloys.

EXAMPLE 2

| | |
|---|---|
| Lithium | 2.8% |
| Magnesium | 0.9% |
| Copper | 1.8% |
| Zirconium | 0.12% |
| Titanium | 0.01% |
| Aluminium | Remainder (including incidental impurities) |

The alloy was cast as a 508 mm×178 mm 300 kg ingot in a direct chill casting system. The ingots were then homogenised for 16 hours at 540° C. and scalped to remove surface imperfections. The ingot was then preheated again to 540° C. and hot rolled to 5 mm thick hot blank.

The blank was heat treated according to the heat treatment schedule detailed in our co-pending UK application No. 8308907. Specifically the 5 mm hot blank was solution treated for one hour at 540° C.; still air cooled and then overaged for 16 hours at 350° C.

The blank was then cold rolled to yield 2 m×1 m size sheets in the gauge range 4 mm to 0.8 mm with intermediate annealing as required. The rolled sheet was then solution treated at 540° C. for twenty minutes, cold water quenched and aged at 170° C. Table 1 details the variation in tensile properties with ageing time in the T6 (unstretched) temper and T8 (stretched 2% prior to ageing) temper for 1.6 mm gauge sheet the properties having been determined for the longitudinal and transverse directions. Similar property levels were achieved on sheet material of gauge in the range 4.0 mm to 0.8 mm.

In the peak aged T6 condition the alloy is capable of achieving an 0.2% PS=440 MPa, tensile strength=520 MPa and elongation=6–7.5%. These properties are significantly higher than the most widely used high strength 2000 series alloy (2014-T6 0.2% proof stress=380 MPa, tensile strength=440 MPa, Elongation=7%; minimum specified properties for sheet). The material also exceeds the minimum property requirements of 7075 sheet in the T73 temper.

In the peak aged T8 condition the alloy is capable of achieving an 0.2% proof stress value of 475 MPa, tensile strength=535 MPa in both longitudinal and transverse test directions, which closely match the fully heat treated minimum sheet specification for 7075 alloy (T6 temper).

The peak aged T8 condition tensile properties are further illustrated in FIG. 3. This shows the variation in longitudinal tensile properties with ageing time at 170° C. for 25 mm plate of the alloy of Example 1 compared with 2014 T651 and 7010 T7651 specifications for 25 mm plate. In the drawing TS=Tensile strength PS=Proof stress EL=Elongation DTD 5120 E and BS 2L93 are the relevant specification standards for the two comparative alloys. This figure shows the statistical variation in 0.2% proof stress and tensile stress for 508 mm×178 mm ingot cast within the specified compositional limits of this application and fabricated to sheet product in the gauge range 5.0 mm to 0.8 mm. The results clearly show that the majority of sheet produced exceeds 7075-T6 0.2% proof stress minimum specified values and that approximately 50% exceeds 7075-T6 minimum tensile strength specified levels. In view of the alloys reduced density (8–10% compared to 7075) the specific strength levels of the alloy are significantly greater than 7075-T6 material.

EXAMPLE 3

| Alloy composition (in weight percent) | |
|---|---|
| Lithium | 2.39 |
| Magnesium | 0.70 |
| Copper | 1.81 |
| Zirconium | 0.16 |
| Titanium | 0.014 |
| Aluminium | Remainder (including incidental impurities) |

The alloy was cast as a 216 mm diameter ingot in a direct chill casting system. The ingot was then homogenised for 16 hours at 540° C. and scalped to remove surface imperfections.

The ingot was then divided into two pieces 185 mm $\phi$×600 mm. These were preheated to 440° C. and extruded using a 212 mm diameter chamber. One was extruded through a 95 mm×20 mm section die at 5 m/min and the other extruded through a 54 mm $\phi$ bar at 5 m/min.

The extruded lengths were solution treated for one hour at 535° C. and quenched in cold water. The material was control stretched 2.5% and aged 16 h at 190° C. Tensile test pieces were taken from the front and back of the extruded length and the tensile results given below:

| Die Section | Position | 0.2% PS (MPa) | TS (MPa) | EL % |
|---|---|---|---|---|
| 95 mm + 20 mm | Front | 560 | 596 | 5.0 |
| | Back | 574 | 611 | 4.5 |
| 54 mm $\phi$ | Front | 605 | 627 | 4.0 |
| | Back | 616 | 624 | 3.5 |

These results indicate that the alloy is capable of achieving 7075-T6 strength levels in extruded form.

EXAMPLE 4

| Alloy composition (in weight percent) | |
|---|---|
| Lithium | 2.56 |
| Magnesium | 0.66 |
| Copper | 1.98 |
| Zirconium | 0.12 |
| Titanium | 0.026 |
| Aluminium | Remainder (including incidental impurities) |

The alloy was cast as a 216 mm diameter ingot in a direct chill casting system. The ingot was then homogenised for 16 h at 540° C. and scalped to remove surface imperfections.

The ingot was then preheated to 480° C. and hard forged to 100 mm+100 mm rectangular bar. The bar was solution heated at 540° C. for 2 hours, cold water quenched and aged for 16 h at 190° C. The tensile properties of the forged bar were:

| | | | |
|---|---|---|---|
| L - duration | 0.2% PS = 459 MPa | TS = 546 MPa | EL = 6 |
| T - duration | 0.2% PS = 401 MPa | TS = 468 MPa | EL = 3 |

The results indicate that the alloy can achieve 7075-T73 properties in forged form.

Table 1

The variation in tensile properties with ageing time at 170° C. for 1.6 mm gauge sheet fabricated as detailed in Example 2. The properties having been determined for the longitudinal and transverse directions.

A. T6 (unstretched) temper

| Ageing time (hours) at 170° C. | Tensile properties: Longitudinal direction 0.2% PS MPa | TS MPa | El % | Transverse direction 0.2% PS MPa | TS MPa | El % |
|---|---|---|---|---|---|---|
| Zero (T4 temper) | 302 | 460 | 11 | 303 | 445 | 15 |
| 4 | 370 | 473 | 5 | 390 | 486 | 6 |
| 16 | 415 | 522 | 5 | 421 | 531 | 5 |
| 64 (peak aged) | 441 | 528 | 6 | 448 | 522 | 6 |

B. T8 (stretched 2% prior to ageing) temper

| Ageing time (hours) at 170° C. | Tensile properties: Longitudinal direction 0.2% PS MPa | TS MPa | El % | Transverse direction 0.2% PS MPa | TS Mpa | El % |
|---|---|---|---|---|---|---|
| 4 | 443 | 517 | 4 | 435 | 496 | 5 |
| 16 | 479 | 547 | 5 | 469 | 511 | 5 |
| 64 | 510 | 566 | 5 | 481 | 534 | 5 |

0.2% PS = 0.2 percent proof stress
TS = Tensile stress
El = Elongation
Mpa = Mega Pascals The alloy in all heat treated conditions has a density saving of 8–10% and a modulus increase of 10–12% when compared to all existing specified aluminium aerospace alloys.

The fracture toughness and fatigue life of sheet material have been determined. The longitudinal-transverse (L-T) fracture toughness (Kc) of 1.6 mm sheet at a proof stress value of 425 MPa was determined as 68.5 MPa $\sqrt{m}$. The L-T mean fatigue life at a proof stress value of 425 MPa was determined as $3.14\times10^5$ cycles at a maximum test stress of 140 MPa (average of three samples). The tests were carried out on notched samples ($K_t$=2.5) and tested in uniaxial tension at a stress ratio of +0.1.

The alloy has been shown to exhibit superplastic behaviour in sheet form with elongations of 400–700% being obtained from cold rolled 1.6 mm sheet, heat treated in the hot blank from prior to cold rolling, according to the previously described aspect of the present invention.

Furthermore it has been demonstrated that the superplastic behaviour of the alloy can be further increased to in excess of 700 percent by the addition of zinc at a level of 1.6 percent.

We have also shown that alloys according to the invention have also been cast in round billet form and extruded with resultant tensile properties being 10–15% higher than those obtained on sheet material for the equivalent heat treated condition.

Alloys according to the invention can also be forged with acceptable properties.

I claim:

1. An aluminium base alloy consisting of a composition within the following ranges in weight percent:

| | |
|---|---|
| Lithium | 2.3 to 2.9 |
| Magnesium | 0.5 to 1.0 |
| Copper | 1.6 to 2.4 |
| Zirconium | 0.05 to 0.25 |
| Titanium | 0 to 0.5 |
| Manganese | 0 to 0.5 |
| Nickel | 0 to 0.5 |
| Chromium | 0 to 0.5 |
| Zinc | 0 to 0.5 |
| Aluminium | Remainder (apart from incidental impurities), |

and in which the ratio of copper to magnesium is between 1.6:1 and 4.8:1.

2. An alloy according to claim 1, in which the ratio of copper to magnesium is about 3:1.

3. A method of producing a sheet or strip comprising hot rolling a rolling ingot of an alloy according to claim 1 in one or more stages to produce a hot blank; holding the hot blank at a temperature and for a time which causes substantially all of the lithium, magnesium, copper and any zinc present to be in solid solution; positively cooling the hot blank; subjecting the cooled blank to a further heat treatment at a temperature sufficient to reprecipitate those age hardening phases in solid solution, continuing the heat treatment to produce a coarse overaged morphology and thereafter cold rolling the blank to form a sheet or strip which at any position therein and in any direction therefrom has properties of elongation that vary from those in the rolling direction by no more than 2.0%.

4. A method according to claim 3 in which the sheet or strip at any position therein and in any direction therefrom has properties of elongation that vary from those in the rolling direction by no more than 25 MPa (0.2% proof stress and tensile stress).

5. A method according to claim 3 in which the initial hot blank holding temperature is between 480° C. and 540° C. and the time varies between 20 and 120 minutes depending upon the thickness and previous thermal history of the blank.

6. A method according to claim 5, in which the hot blank is positively cooled by air blast cooling.

7. A method according to claim 3 in which if the hot blank falls to a temperature below 480° C. the blank is re-heated to solutionise the Li, Mg, Cu and any Zn.

8. A method according to claim 3 in which the hot blank has a thickness of 12.5 mm to 3 mm.

9. A method according to claim 3 in which the sheet or strip has a thickness up to 10 mm.

10. A method according to claim 5 in which the positive cooling terminates at the temperature of the further heat treatment so that the positive cooling and further heat treatment steps are merged together.

11. A method according to claim 10 in which the further heat treatment is at a temperature between 300° C. and 400° C. for a period of 8 to 16 hours.

12. A method according to claim 4 in which the initial hot blank holding temperature is between 480° C. and 540° C. and the time varies between 20 and 120 minutes depending upon the thickness and previous thermal history of the blank.

13. A method according to claim 12, in which the hot blank is positively cooled by air blast cooling.

14. A method according to claim 5 in which if the hot blank falls to a temperature below 480° C. the blank is re-heated to solutionize the Li, Mg, Cu and any Zn.

15. A method according to claim 7 in which the hot blank has a thickness of 12.5 mm to 3 mm.

16. A method according to claim 5 in which the hot blank has a thickness of 12.5 mm to 3 mm.

17. A method according to claim 3 in which the sheet or strip has a thickness no more than 5 mm.

18. A method according to claim 5 in which the sheet or strip has a thickness up to 10 mm.

19. A method according to claim 8 in which the sheet or strip has a thickness no more than 5 mm.

20. A method according to claim 12 in which the positive cooling terminates at the temperature of the further heat treatment so that the positive cooling and further heat treatment steps are merged together.

* * * * *